US006014081A

United States Patent [19]

Kojima et al.

[11] Patent Number: 6,014,081

[45] Date of Patent: Jan. 11, 2000

[54] DRIVING CONDITION-MONITORING APPARATUS FOR AUTOMOTIVE VEHICLES

[75] Inventors: Kouichi Kojima; Kenji Yoshikawa, both of Wako, Japan

[73] Assignee: Honda Giken Kogyo Kabushiki Kaisha, Tokyo, Japan

[21] Appl. No.: 09/000,281

[22] PCT Filed: Jul. 25, 1996

[86] PCT No.: PCT/JP96/02089

§ 371 Date: May 22, 1998

§ 102(e) Date: May 22, 1998

[87] PCT Pub. No.: WO97/04977

PCT Pub. Date: Feb. 13, 1997

[30] Foreign Application Priority Data

Jul. 28, 1995 [JP] Japan ..... 7-211384

[51] Int. Cl.[7] ..... G08B 23/00

[52] U.S. Cl. ..... 340/576; 340/575; 340/439; 340/995; 701/208

[58] Field of Search ..... 340/576, 575, 340/439, 995, 988, 441, 691.2, 691.6; 701/207, 208

[56] References Cited

U.S. PATENT DOCUMENTS 5,694,116 12/1997 Kojima ..... 340/576

FOREIGN PATENT DOCUMENTS 5325098 10/1993 Japan .
5262163 12/1993 Japan .

*Primary Examiner*—Jeffery A. Hofsass
*Assistant Examiner*—Sihong Huang
*Attorney, Agent, or Firm*—Carrier, Blackman & Associates, P.C.; Joseph P. Carrier; William D. Blackman

[57] ABSTRACT

When an automotive vehicle travels to come near one of rest points set in advance (S4), when the abnormality of the driving condition of the driver, or when a continuous driving time period over which the vehicle is continuously driven becomes equal to or longer than a predetermined time period T1, the driver is instructed to take a rest (step S14). When the driver is instructed to take a rest at a point other than the scheduled rest points, a suitable rest point is searched for (S13) to instruct the driver to take a rest there, and subsequent ones of the scheduled rest points are changed (S17).

5 Claims, 9 Drawing Sheets

YAW RATE YR

YAW ANGLE YA

MODIFIED YAW ANGLE YAM

LATERAL DEVIATION DIFFERENTIAL QUANTITY DYK

LATERAL DEVIATION YK

DRIVING CONDITION-MONITORING APPARATUS FOR AUTOMOTIVE VEHICLES

TECHNICAL FIELD

This invention relates to a driving condition-monitoring apparatus for automotive vehicles, which instructs the driver to take a rest depending on the driving condition of an automotive vehicle.

BACKGROUND ART

A long-time driving-warning apparatus for an automotive vehicle is conventionally known which measures a traveling time of the automotive vehicle, and detects a geographical position of the vehicle whenever the measured traveling time reaches a predetermined time period, to search the vicinity of the detected geographical position of the vehicle for a place where the driver can take a rest, and supply information on the place to the driver (Japanese Laid-Open Patent Publication (Kokai) No. 5-262163).

However, the conventional apparatus does not contemplate cases where the driver becomes fatigued before the traveling time reaches the predetermined time period, and therefore there remains room for improvement.

The present invention has been made in view of the above inconvenience, and it is an object of the invention to provide a driving condition-monitoring apparatus for automotive vehicles, which is capable of instructing the driver to take a rest at more suitable timing through monitoring the driving condition of the driver.

DISCLOSURE OF THE INVENTION

The present invention provides a driving condition-monitoring apparatus for an automotive vehicle, shown in FIG. 1, which is comprised of driving time-measuring means 1 for measuring a continuous driving time period over which the vehicle is continuously driven, driving condition-determining means 2 for determining a driving condition of a driver of the vehicle, rest necessity-determining means 3 for determining, based on the continuous driving time period and the driving condition of the driver, whether or not it is necessary for the driver to take a rest, map information output means 5 for outputting map information including information on roads on which the automotive vehicle is to travel, vehicle position-detecting means 6 for detecting a position of the vehicle within the map information, route-setting means 7 for setting a driving route to a destination of a drive of the vehicle, scheduled rest point-setting means 8 for setting rest points along the driving route set by the route-setting means at intervals of a predetermined distance and/or a predetermined expected traveling time period, extraordinary rest point search means 4 for searching a place in the vicinity of the position of the vehicle as an extraordinary rest point suitable for the driver to take a rest when it is determined that it is necessary for the driver to take a rest, and rest-instructing means 9 for indicating one of the scheduled rest points when the vehicle comes near the one of the scheduled rest points and indicating the extraordinary rest points when it is determined that it is necessary for the driver to take a rest.

Wherein, when it is determined that it is necessary for the driver to take a rest and then the driver takes a rest at the rest point newly searched out by the rest point search means, the rest point-setting means 8 changes subsequent ones of the set rest points.

Preferably, the scheduled rest point-setting means 8 changes the subsequent ones of the scheduled rest points in a manner such that the rest points are set at shorter intervals of a distance and/or a time period than the intervals of the predetermined distance and/or the predetermined expected traveling time.

Preferably, the driving condition-monitoring apparatus includes vehicle speed-detecting means for detecting a vehicle speed at which the automotive vehicle is traveling, and wherein the rest necessity-determining means 3 determines whether it is necessary for the driver to take a rest only when the vehicle speed is equal to or higher than a predetermined value.

Preferably, the rest-instructing means 9 displays a map including the rest points.

Preferably, the rest-instructing means 9 instructs the driver to take a rest by using voices or by an indicator.

According to the present invention, it is determined, based on a continuous driving time period over which the automotive vehicle is continuously driven and the driving condition of the driver, whether or not it is necessary for the driver to take a rest, and if it is determined that it is necessary for the driver to take a rest, the driver is given instructions to take a rest, including information on a suitable rest point.

BEST MODE OF CARRYING OUT THE INVENTION

Next, the invention will now be described in detail with reference to drawings showing a preferred embodiment thereof.

Figure 1:
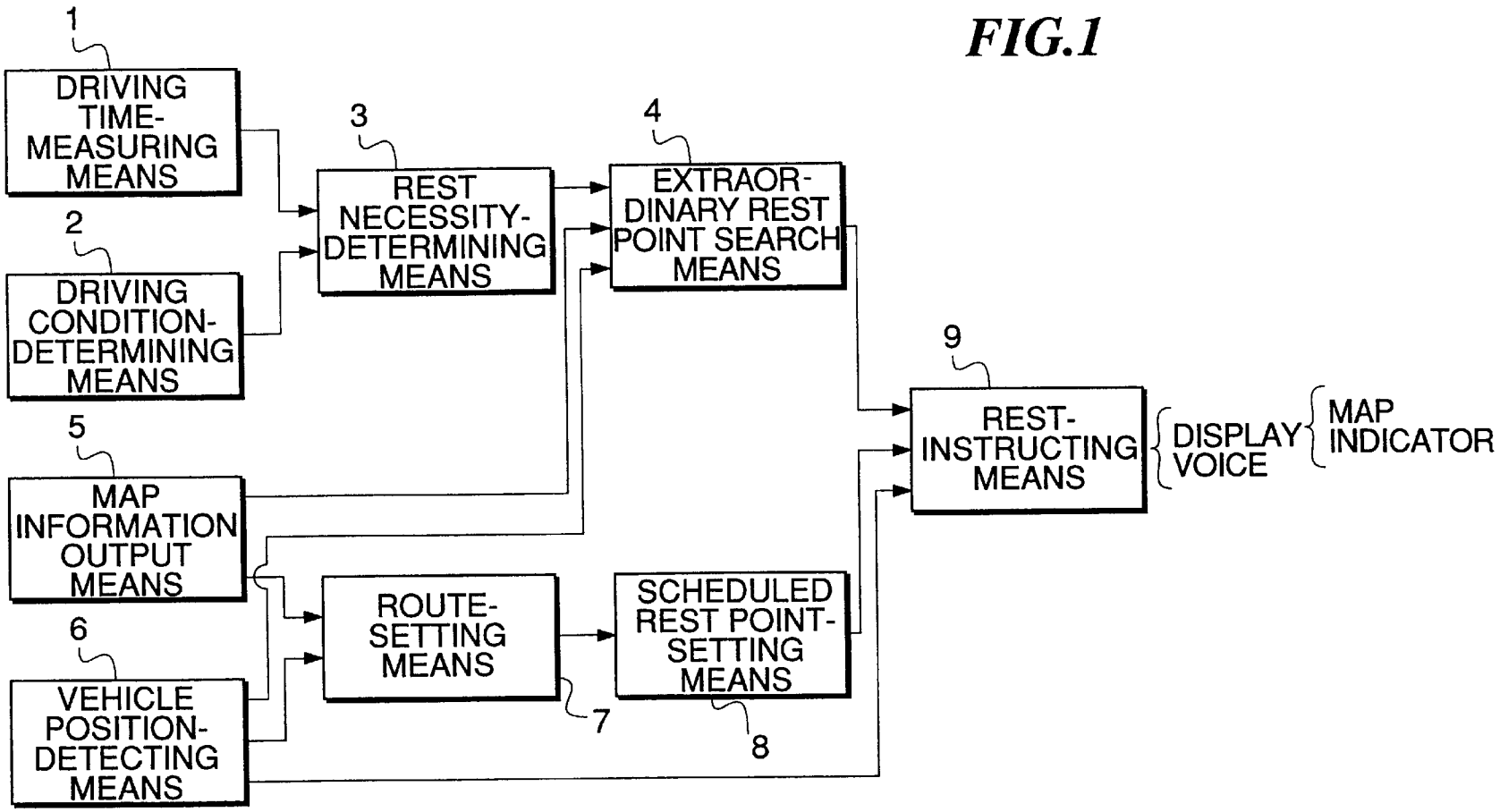
FIG. 1 is a diagram showing the construction of the invention.
Figure 2:
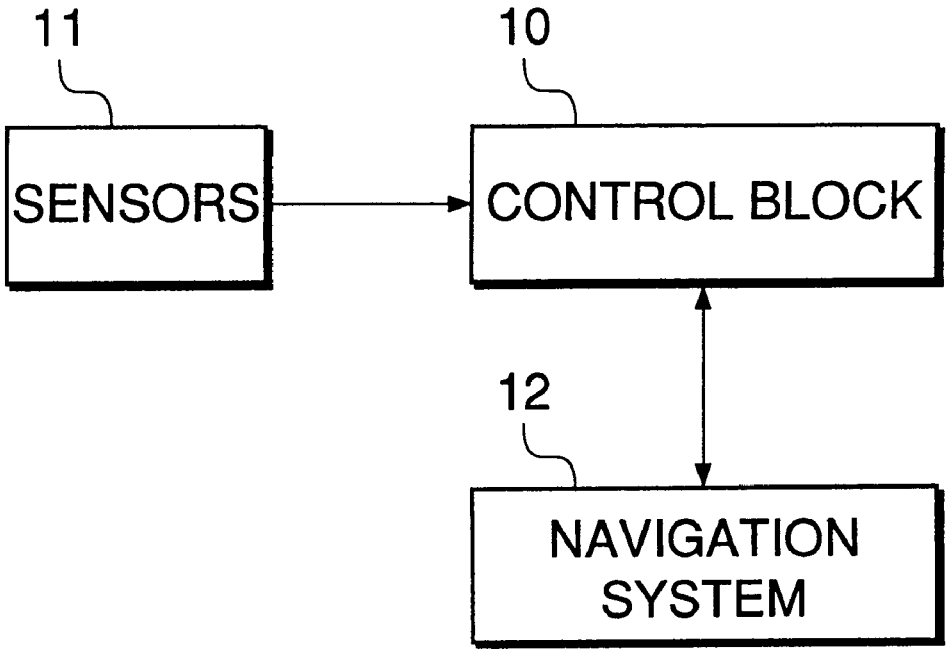
FIG. 2 is a diagram showing the arrangement of a driving condition-monitoring apparatus for automotive vehicles, according to an embodiment of the invention.

FIG. 2 shows the construction of a driving condition-monitoring apparatus for automotive vehicles, according to an embodiment of the invention, which is comprised of a control block 10 for controlling the overall operation of the apparatus, various sensors 11 for detecting the vehicle speed, a yaw rate, etc., and a navigation system 12 of a well known type. The navigation system 12 includes a display device for displaying a map, etc., and a voice output device comprised of a loudspeaker for giving instructions in voice. The control block 10 includes a CPU for carrying out various arithmetic operations, a ROM storing programs executed by the CPU, a RAM used for execution of arithmetic operations by the CPU, a timer for measuring a time period, etc., and cooperates with the navigation system 12 to carry out a control process, described in detail hereinafter.

According to the present embodiment, the control block 10 forms driving time-measuring means 1, part of driving condition-determining means 2, rest necessity-determining means 3, rest point search means 4, rest point-setting means 8, and part of rest-instructing means 9, and the sensors 11 form part of the driving condition-determining means 2, while the navigation system 12 forms map information output means 5, vehicle position-detecting means 6, route-setting means 7, and part of the rest-instructing means 9.

Figure 3:
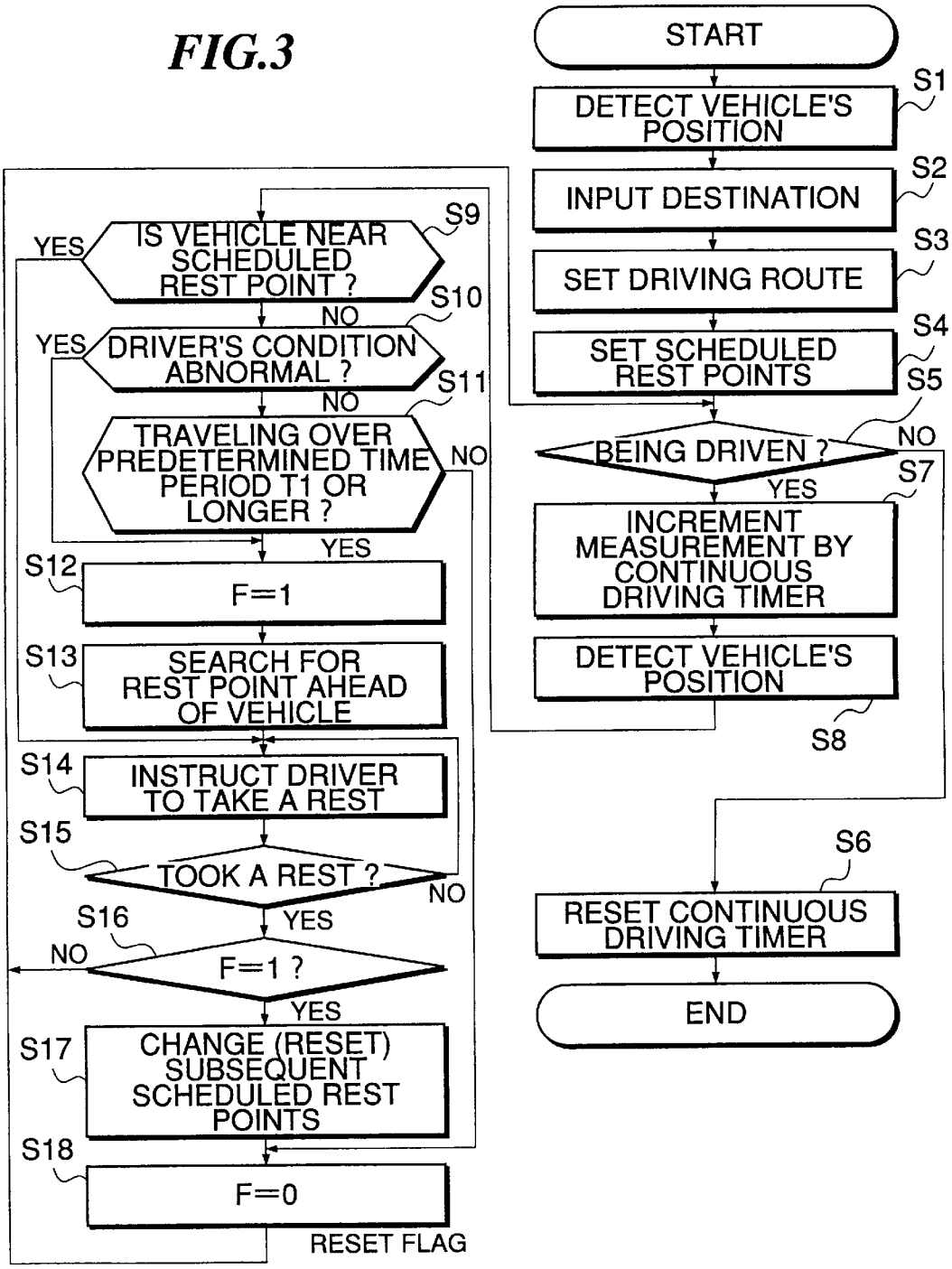
FIG. 3 is a flowchart showing a routine executed by the FIG. 2 apparatus for instructing the driver to take a rest.

FIG. 3 is a flowchart showing the control process which the control block 10 and the navigation system 12 cooperate to carry out.

First, at a step S1, the present position of the automotive vehicle (the vehicle's position) is detected. When the driver inputs destination of his drive (at a step S2), a driving route is set (at a step S3). The steps S1 to S3 are carried out by the navigation system 12.

At the following step S4, the control block 10 sets scheduled rest points. Although the scheduled rest points are set along the driving route set at the step S3 at intervals of a predetermined distance, this is not limitative, but they may be set at intervals of a predetermined expected traveling time period. Further alternatively, these two manners of setting the scheduled rest points may be employed in combination such that for sections of the driving route which are expected to be congested, scheduled rest points may be set with priority given to the time-based setting manner, and for the other sections, with priority given to the distance-based setting manner.

At the following step S5, it is determined whether or not the vehicle is being driven. The term "being driven" of the vehicle means not only a state in which the vehicle is "traveling" (vehicle speed V>0), but also a state in which the vehicle temporarily stops due to congestion or a traffic signal. Therefore, when the ignition switch has been turned off, or when a state of vehicle velocity V=0 has continued over a predetermined time period, it is determined that the vehicle is "not being driven". When the vehicle is not being driven, the program proceeds to a step S6, wherein a continuous driving timer TCDRV for measuring a time period over which the vehicle is continuously driven is reset, followed by terminating the program.

On the other hand, if the vehicle is determined to be driven, the count of the continuous driving timer TCDRV is incremented at a step S7, and the vehicle's position is detected at a step S8. Then, it is determined whether or not the vehicle has come near a scheduled rest point, and if the vehicle is determined to have come near a scheduled rest point, the program immediately proceeds to a step Sl4.

If the vehicle has not come near a scheduled rest point, it is determined at a step S10 whether or not the driving condition of the driver is abnormal. This determination can be carried out in various ways and will be described hereinafter. If it is determined at the step S10 that the driving condition of the driver is abnormal, the program immediately proceeds to a step S12, whereas if it is determined that the driving condition of the driver is not abnormal, it is determined whether or not the vehicle has been driven continuously over a predetermined time period T1 or longer, i.e. the time measured by the continuous driving timer TDCRV has become equal to or longer than the predetermined time period T1. If TCDRV<T1 holds, the program immediately proceeds to a step S18, whereas if TDCRV≧T1 holds, the program proceeds to the step S12.

At the step S12, a flag F, which, when set to "1", indicates that the driving condition of the driver is abnormal or the vehicle has been driven continuously over the predetermined time period T1 or longer, is set to "1", and then a suitable point for taking a rest which is located ahead of the vehicle's position is searched for, and sets the nearest suitable point to a rest point where the driver should take a rest, at a step S13, followed by the program proceeding to a step S14.

Figure 4:
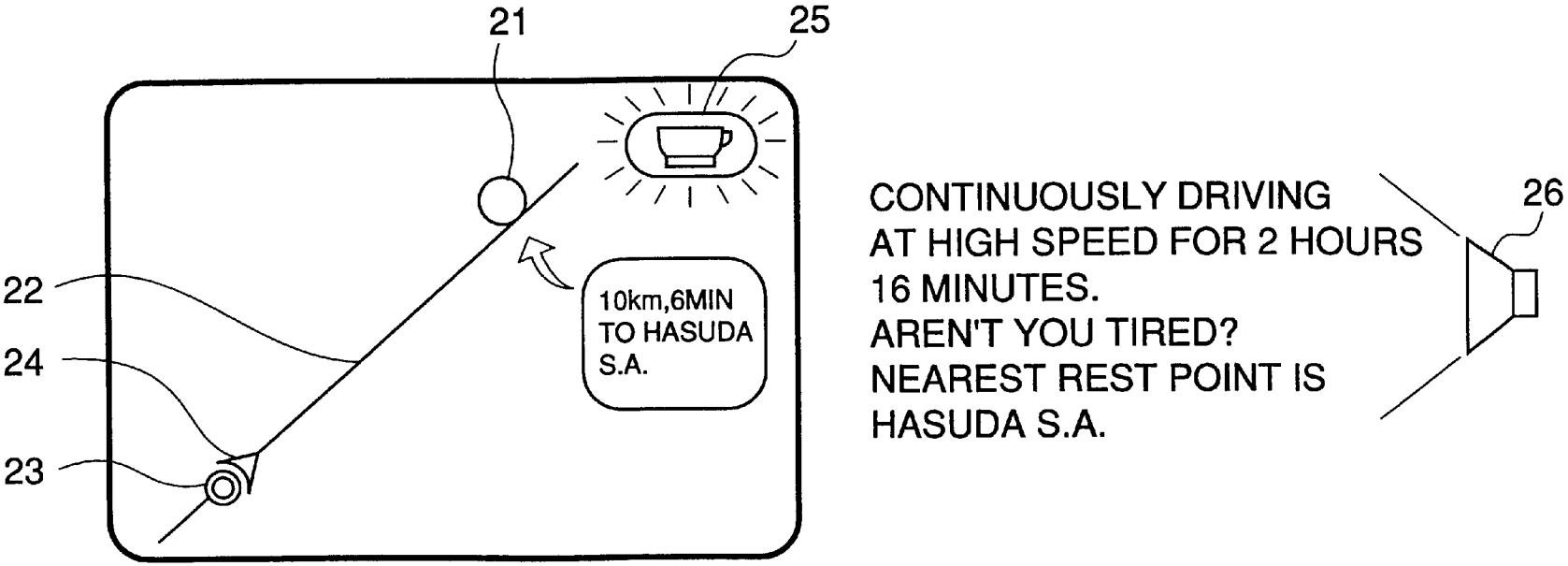
FIG. 4 is a diagram which is useful in explaining a manner of instructing the driver to take a rest.

At the step S14, instructions for taking a rest are given to the driver. More specifically, the instructions are given by displaying the rest point 21 (Hasuda Service Area in the illustrated example) on the map as well as a distance from the vehicle's position to the rest point and time the vehicle is expected to take to reach there, as shown in FIG. 4. In this figure, reference numeral 22 designates an image indicative of the driving route on the map, 23 an image indicative of the vehicle's position, and 24 an image indicative of the advancing or traveling direction. Further, the instructions may be given by lighting an indicator 25 or by voice produced by a voice output device 26.

Referring again to FIG. 3, it is determined at the step S15 whether or not the driver has actually taken a rest. If the driver has not taken a rest, the program returns to the step S14 to instruct the driver to take a rest. If the driver has taken a rest, it is determined whether or not the flag F assumes "1". If F=0 holds, i.e. if the driver has taken a rest at the scheduled rest point, the program immediately returns to the step S5, whereas if F=1 holds, and hence the driver has taken a rest before the next scheduled rest point is reached, the subsequent scheduled rest points are changed at a step S17, followed by the program proceeding to the step S18. When the subsequent scheduled rest points are changed at the step S17, it is desired that the intervals of distance between new rest points are made shorter than the original intervals of the predetermined distance, since the driver is fatigued.

At the step S18, the flag F is reset to "0", followed by the program returning to the step S5.

Figure 5:
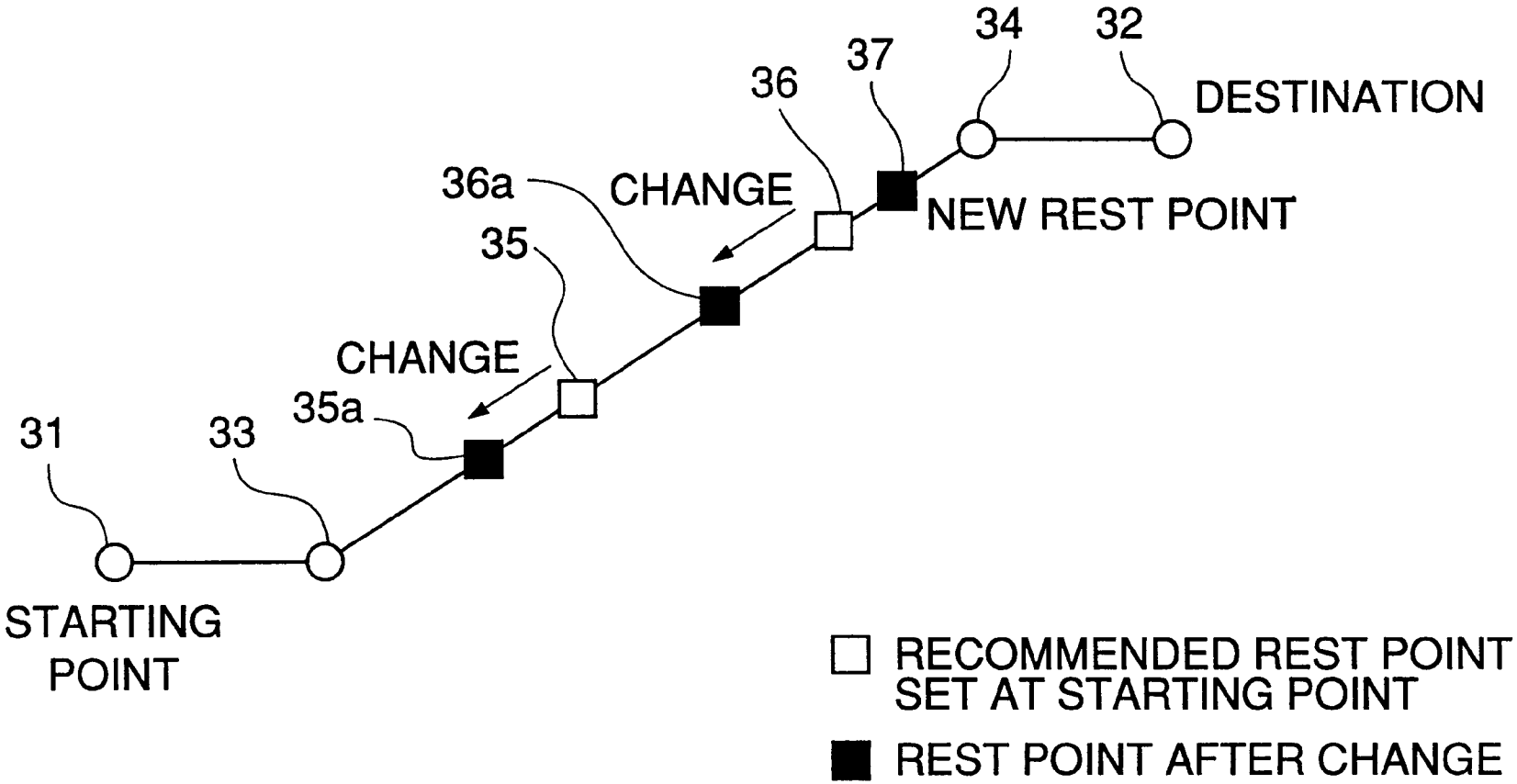
FIG. 5 is a diagram which is useful in explaining a manner of setting or changing rest points.

As described above, according to the FIG. 3 control process, if a driving route from a starting point 31 to a destination 32 is set, rest points (recommended rest points) 35 and 36 are set, as shown in FIG. 5. The illustrated example shows a case where the vehicle is traveling on an express way, and reference numerals 33 and 34 designate interchanges.

If the rest points are not changed during traveling, the driver is instructed to take a rest at the points 35 and 36, but if the driving condition of the driver is detected to be abnormal before the vehicle reaches the point 35, or if the continuous driving time period becomes equal to or longer than the predetermined time period T1, the scheduled rest point 35 is changed to a rest point 35*a*. In this case, the next scheduled rest point 36 is also changed to a rest point 36*a*, and a new rest point 37 is additionally set. The intervals of distance based on which the rest points 35*a*, 36*a*, and 37 are set shorter than those employed in setting the original scheduled rest points.

As described above, according to the FIG. 3 control process, the driver is instructed to take a rest not only based on the continuous driving time period but also based on the driving condition of the driver. As a result, the driver is instructed to take a rest at more suitable timing dependent on the degree of his fatigue. Further, the instructions for taking a rest contain information on a rest point found by search, which reduces the burden on the driver.

In addition to the above-mentioned manners of instructing the driver to take a rest at the step S14, it is also possible to give instructions by lighting a lamp (indicator) built in an instrument panel, not shown, or by producing a voice.

Figure 6:
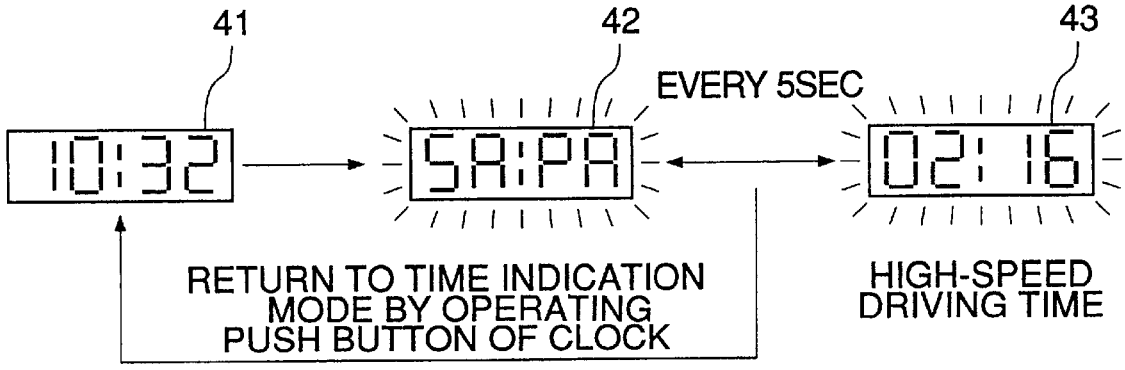
FIG. 6 is a diagram which is useful in explaining another manner of instructing the driver to take a rest.

Further, there may employed a method as illustrated in FIG. 6, in which a clock of a digital display type a normal operative state of which is indicated by reference numeral 41 may be caused to repeat a display indicated by reference numeral 42 and a display indicated by reference numeral 43 alternately at intervals of five seconds. In the state 42, images of "SA, PA" are displayed, while in the state 43, the continuous driving time period (2 hours 16 minutes in the illustrated example) is displayed. The driver can cause the clock to return to its normal operative state by pushing a predetermined push button thereof.

Further, the apparatus may be configured such that the driver can set a threshold value (predetermined time period T1) with reference to which the driver is instructed to take a rest.

Figure 7:
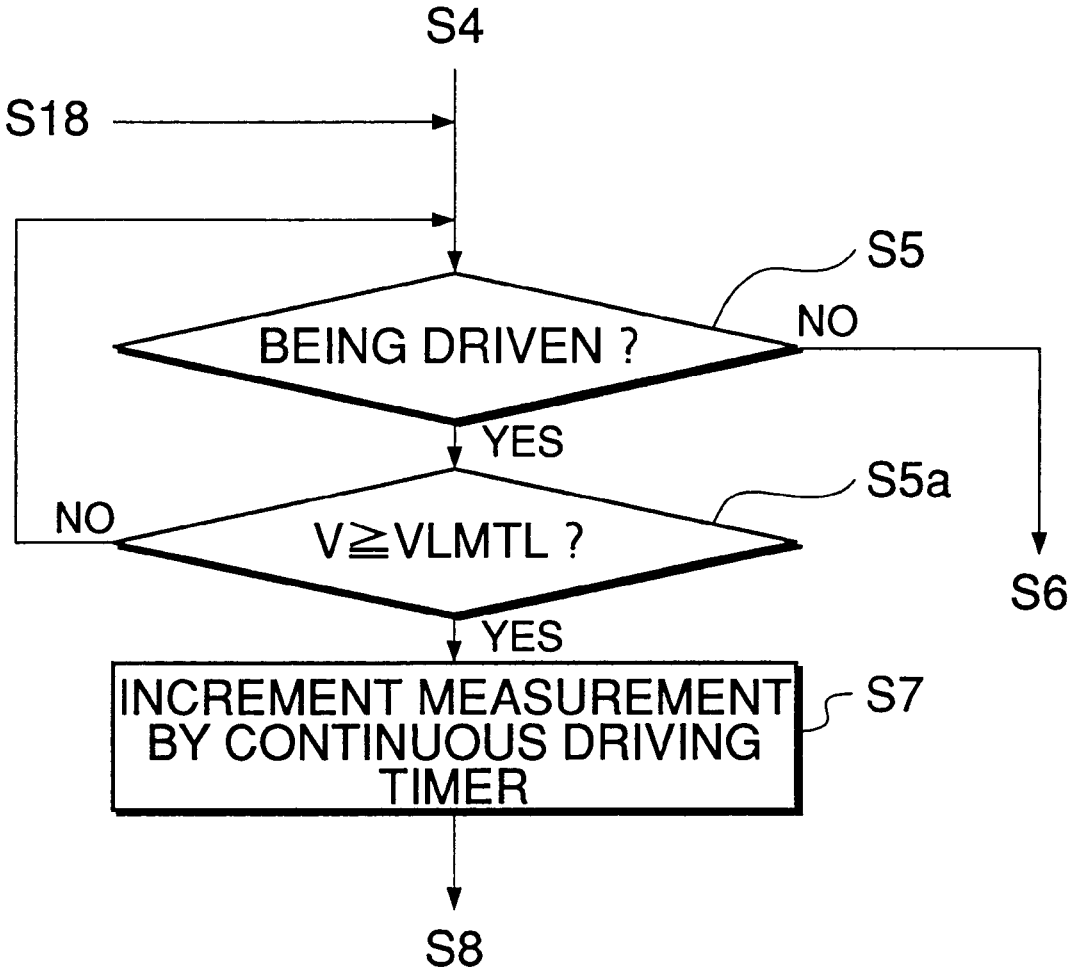
FIG. 7 is a flowchart showing a variation of the FIG. 3 routine.

As another variation, as shown in FIG. 7, a step S5*a* may be interposed between the step S5 and S7. That is, according to this variation, it is determined whether or not the vehicle speed V is equal to or higher than a predetermined value VLMTL. If V<VLMTL holds, the program proceeds to the step S5, whereas if V≧VLMTL holds, the program proceeds to the step S7. This makes it possible to determine whether or not it is necessary for the driver has to take a rest only when the vehicle is traveling at a vehicle speed equal to or higher than the predetermined vehicle speed.

Next, the manner of determining the abnormality of the driving condition of the driver at the step S10 in FIG. 3 will be described with reference to FIGS. 8 and 9.

Figure 8:
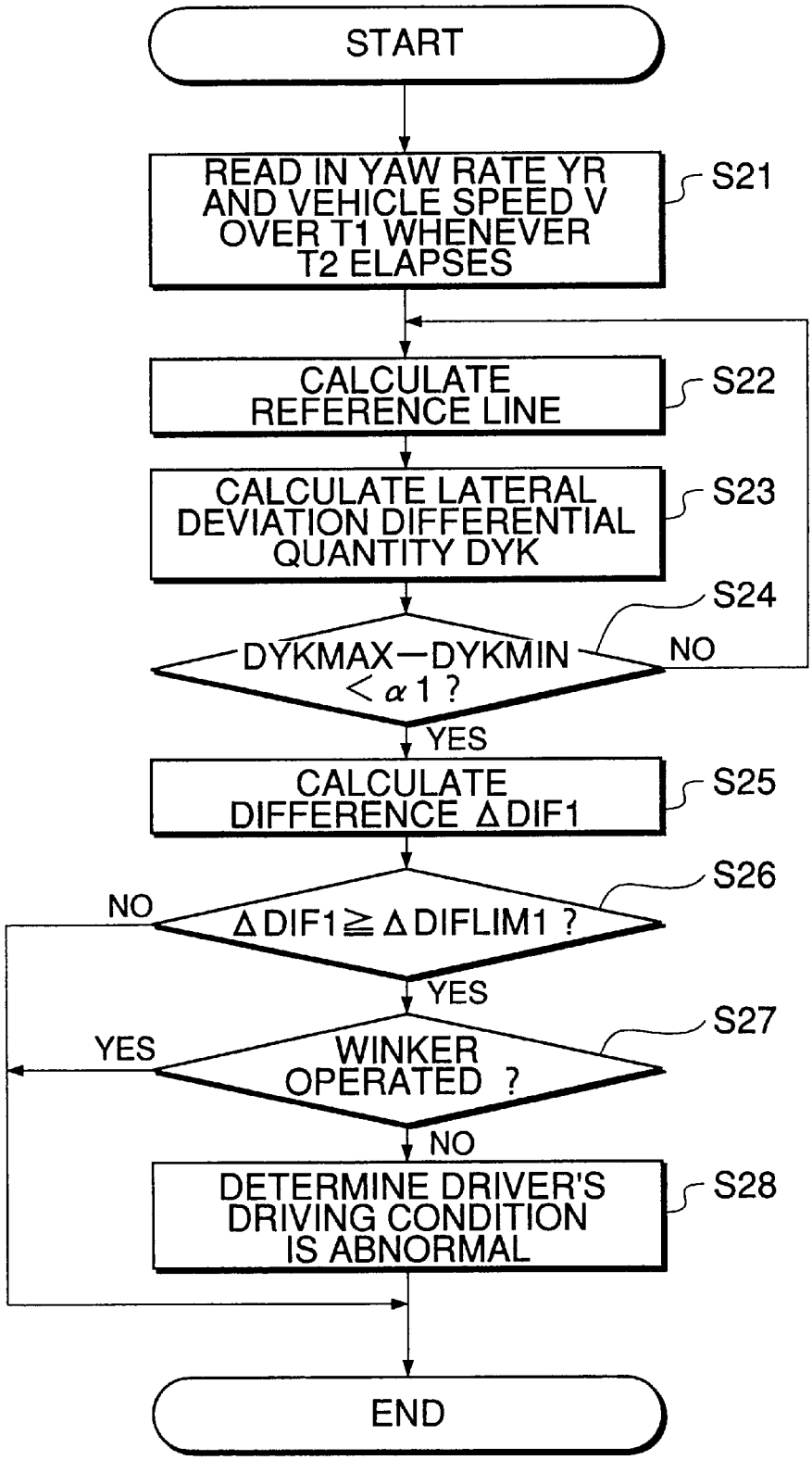
FIG. 8 is a flowchart showing a routine for determining abnormality of the driver.
Figure 9A:
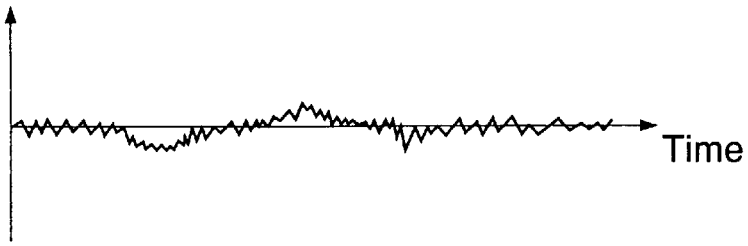
FIG. 9 is a timing chart which is useful in explaining the FIG. 8 routine.
Figure 9B:
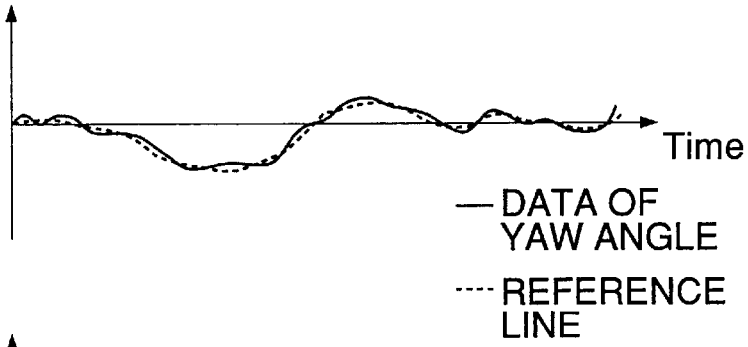
Figure 9C:
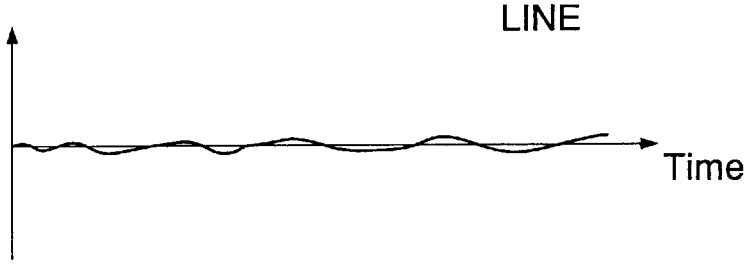
Figure 9D:
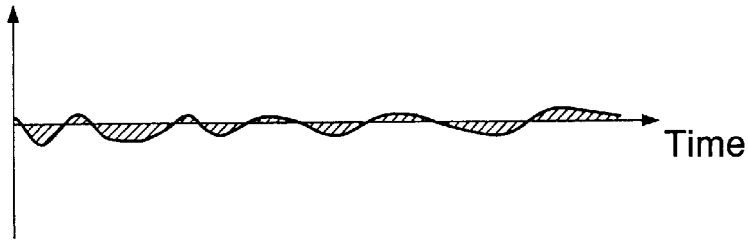
Figure 9E:
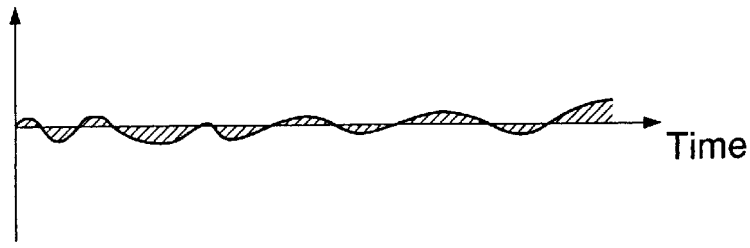

FIG. 8 shows a routine for determining abnormality of the driving condition of the driver by calculating a reference line or a lane along which the vehicle should travel as well as a parameter (difference ΔDIF1) indicative of a deviation of the vehicle from the reference line, based on a sensed yaw rate YR and the vehicle speed V, and then determining the abnormality of the driving condition of the driver based on the calculated difference ΔDIF1.

First, at a step S21, data of the yaw rate YR and the vehicle speed V detected over a predetermined time period T1 (e.g. 30 seconds) before the present time are read in whenever a predetermined time period T2 (e.g. 10 seconds) elapses. Then, the reference line and a lateral deviation differential quantity DYK are calculated at steps S22 and S23, respectively.

The reference line and the lateral deviation differential quantity DYK are calculated in the following manner:

First, the input yaw rate YR (FIG. 9(*a*)) is time-integrated into a yaw angle YA (FIG. 9(*b*)), and further the reference line (indicated by the broken line in FIG. 9(*b*)) is calculated, based on the yaw angle YA. Specifically, this calculation is carried out by a least-square method, which is well known, in the following manner:

Let it be assumed, e.g. that yaw angle values YA1, YA2, and YA3 were obtained at time points t1, t2, and t3, respectively. The reference line can be approximated by the following linear expressions:

$$YA1=b1+b2t1+e1$$

$$YA2=b1+b2t2+e2$$

$$YA3=b1+b2t3+e3$$

where e1 to e3 represent residuals, and terms b1 and b2 are determined such that the sum of the squares of the residuals e1 to e3 becomes the minimum. The reference line can also be approximated by the following quadratic expressions:

$$YA1=b1+b2t1+b3t1^2+e1$$

$$YA2=b1+b2t2+b3t2^2+e2$$

$$YA3=b1+b2t3+b3t3^2+e3$$

where terms b1 to b3 are determined such that the sum of the squares of the residuals e1 to e3 becomes the minimum.

Further, the reference line can be approximated by the following cubic expressions:

$$YA1=b1+b2t1+b3t1^2+b4t1^3+e1$$

$$YA2=b1+b2t2+b3t2^2+b4t2^3+e2$$

$$YA3=b1+b2t3+b3t3^2+b4t3^3+e3$$

where terms b1 to b4 are determined such that the sum of the squares of the residuals e1 to e3 becomes the minimum.

When the number of sampled data items is larger, higher degree expressions are further employed to carry out more accurate approximation.

In the present embodiment, first, the reference line is determined by the use of the linear expressions, and then a modified yaw angle YAM (FIG. 9(*c*)) is calculated by subtracting a reference yaw angle corresponding to the reference line from the determined yaw angle YA. Further, the lateral deviation differential quantity DYK (FIG. 9(*d*)) is calculated by applying the modified yaw angle YAM and the vehicle speed V to the following equation:

$$DYK=V\times\sin(YAM)$$

Referring again to FIG. 8, at the next step S24, it is determined whether or not the difference between the maximum value DYKMAX of the lateral deviation differential quantity DYK and the minimum value DYKMIN of the same is smaller than a predetermined value α1. If (DYKMAX−DYKMIN)≧α1 holds, the program returns to the step S22, wherein the order of approximation of the reference line is increased by one order to again calculate the reference line. This procedure is repeatedly carried out until the answer to the question of the step S24 becomes affirmative (YES).

Alternatively, the calculation of the reference line may be terminated when the order of approximation has reached a predetermined value, even if (DYKMAX−DYKMIN) ≧α1 holds.

If (DYKMAX−DYKMIN)<α1 holds at the step S24, the program proceeds to a step S25, wherein the difference ΔDIF1 is calculated. Then, it is determined at a step S26 whether or not the difference ΔDIF1 is equal to or larger than a predetermined reference value ΔDIFLIM1. If ΔDIF124 ΔDIFLIM1 holds, it is determined at a step S27 whether or not a winker is in operation. If ΔDIF1<ΔDIFLIM1 holds or if the winker is in operation, the program is immediately terminated, whereas if ΔDIF1≧ΔDIFLIM1 holds and at the same time the winker is not in operation, it is determined that the driving state of the driver is abnormal, followed by terminating the program.

As described above, according to the FIG. 8 routine, it is possible to determine the abnormality of the driving condition of the driver based on behavior of the automotive vehicle.

Further, the abnormality of the driving condition of the driver may be determined (detected) by executing, e.g. a method of determining a doze of the driver based on the frequency of operations of the steering wheel and the accelerator pedal as disclosed by Japanese Patent Publication (Kokoku) No. 54-24569, a method of detecting the position of an upper part of the driver's body by a camera and determining a doze of the driver based on periodic changes in the detected position of the upper part of the driver's body as disclosed by Japanese Patent Publication (Kokoku) No. 4-75560, a method of detecting an electric potential on the skin of the driver and detecting a strained state and a lowered awakeness state of the driver based on the detected potential as disclosed by Japanese Laid-Open Patent Publication (Kokai) No. 5-24460, a method of detecting a doze of the driver based on information on a driver's body, such as an electroencephalogram, a countenance, and body temperature as disclosed by Japanese Laid-Open Patent Publication (Kokai) No. 5-96971, and a method of picking up an image of a road in front of the running vehicle by a camera to thereby detect transverse displacement of the running vehicle, and detecting a doze of the driver based on the detected transverse displacement as disclosed in Japanese Laid-Open Patent Publication (Kokai) No. 5-69757, etc. In short, the abnormality of the driving condition of the driver may be determined not only based on the behavior of the vehicle, but also based on driving operations, or states or conditions (posture, body temperature, etc.) of the driver.

Industrial Applicability

As described in detail heretofore, according to the present invention, it is determined whether or not it is necessary for the driver to take a rest, based on a continuous driving time period over which the vehicle is continuously driven and the driving condition of the driver, and when it is determined that it is necessary for the driver to take a rest, the driver is instructed to take a rest. Therefore, it is possible to instruct the driver to take a rest at more suitable timing in a manner dependent on a degree of his fatigue. Further, the instructions for taking a rest contains information on a rest point found by search, which reduces the burden on the driver.

We claim:

1. A driving condition-monitoring apparatus for an automotive vehicle, comprising driving time-measuring means for measuring a continuous driving time period over which said vehicle is continuously driven, driving condition-determining means for determining a driving condition of a driver of said vehicle, rest necessity-determining means for determining, based on said continuous driving time period and said driving condition of said driver, whether or not it is necessary for the driver to take a rest, map information output means for outputting map information including information on roads on which said automotive vehicle is to travel, vehicle position-detecting means for detecting a position of said vehicle within said map information, route-setting means for setting a driving route to a destination of a drive of said vehicle, scheduled rest point-setting means for setting rest points along said driving route set by said route-setting means at intervals of a predetermined distance and/or a predetermined expected traveling time period, extraordinary rest point search means for searching a place in the vicinity of said position of said vehicle as a rest point suitable for said driver to take a rest when it is determined that it is necessary for said driver to take a rest, and rest-instructing means for indicating one of said scheduled rest points when said vehicle comes near said one of said scheduled rest points and indicating said extraordinary rest point when it is determined that it is necessary for said driver to take a rest, wherein when it is determined that it is necessary for said driver to take a rest and then said driver takes a rest at said extraordinary rest point newly searched out by said rest point search means, said scheduled rest point-setting means changes subsequent ones of said scheduled rest points.

2. A driving condition-monitoring apparatus according to claim 1, wherein said scheduled rest point-setting means changes said subsequent ones of the scheduled rest points in a manner such that the rest points are set at shorter intervals of a distance and/or a time period than said intervals of said predetermined distance and/or said predetermined expected traveling time.

3. A driving condition-monitoring apparatus according to claim 1, including vehicle speed-detecting means for detecting a vehicle speed at which said automotive vehicle is traveling, and wherein said rest necessity-determining means determines whether it is necessary for said driver to take a rest only when said vehicle speed is equal to or higher than a predetermined value.

4. A driving condition-monitoring apparatus according to claim 1, wherein said rest-instructing means displays a map including said rest points.

5. A driving condition-monitoring apparatus according to claim 4, wherein said rest-instructing means instructs said driver to take a rest by using voices or by an indicator.

* * * * *

UNITED STATES PATENT AND TRADEMARK OFFICE

CERTIFICATE OF CORRECTION

PATENT NO : 6,014,081

DATED : 11 January 2000

INVENTOR(S) : Kouichi Kojima, Kenji Yoshikawa

It is certified that error appears in the above-identified patent and that said Letters Patent is hereby corrected as shown below:

On the cover page, under "FOREIGN PATENT DOCUMENTS", change "5325098 10/1993 Japan" to --5325098 12/1993 Japan--;
change "5262163 12/1993 Japan" to --5262163 10/1993 Japan--.

Column 1, line 60, delete the period;
line 61, change "Preferably, when" to --, wherein when-- (continuation of the sentence on line 60).

Column 6, line 50, change "ΔDIF124" to --ΔDIF1 ≧--.

Column 8, line 26 (claim 2, 3rd line), change "the scheduled" to --said scheduled--.

Signed and Sealed this

Twenty-fourth Day of October, 2000

*Attest:*

Q. TODD DICKINSON

*Attesting Officer*

*Director of Patents and Trademarks*